United States Patent [19]

Bond

[11] 4,169,548

[45] Oct. 2, 1979

[54] FLEXIBLE DISPENSER VALVE

[75] Inventor: Curtis J. Bond, Marion, Ohio

[73] Assignee: Liqui-Box Corporation, Columbus, Ohio

[21] Appl. No.: 886,179

[22] Filed: Mar. 13, 1978

[51] Int. Cl.[2] ..... B65D 47/20

[52] U.S. Cl. ..... 222/505; 222/511; 222/538; 251/339

[58] Field of Search ..... 222/498, 501, 505, 511, 222/515, 528, 529, 530, 531, 532, 538; 251/175, 339, 342

[56] References Cited

U.S. PATENT DOCUMENTS

| | | | |
|---|---|---|---|
| 3,039,656 | 6/1962 | Wentz | 222/538 X |
| 3,173,579 | 3/1965 | Curie et al. | 222/528 X |
| 3,400,866 | 9/1968 | Fattori | 222/511 |
| 3,443,728 | 5/1969 | Scholle | 222/511 |
| 3,595,445 | 7/1971 | Buford | 222/213 |
| 3,972,452 | 8/1976 | Welsh | 222/511 X |

*Primary Examiner*—David A. Scherbel
*Attorney, Agent, or Firm*—William V. Miller

[57] ABSTRACT

A dispensing valve for liquid containers of the type which is normally actuated by a resiliently flexible concave diaphragm to automatically close or self-seal it but which can be manually opened a toggle arrangement including an actuating lever or tab extension projecting outwardly from the concave diaphragm. In combination with this automatically-closing toggle-actuated diaphragm structure, an extended spout is provided for slidably mounting the valve so that during shipping or when the container is not to be used for dispensing during relatively long periods, the valve is in a retracted non-dispensing position where it will be provided with an additional seal and where the valve cannot be accidentally opened by engaging the toggle lever or by shock but can be extended readily to dispensing position when desired.

18 Claims, 15 Drawing Figures

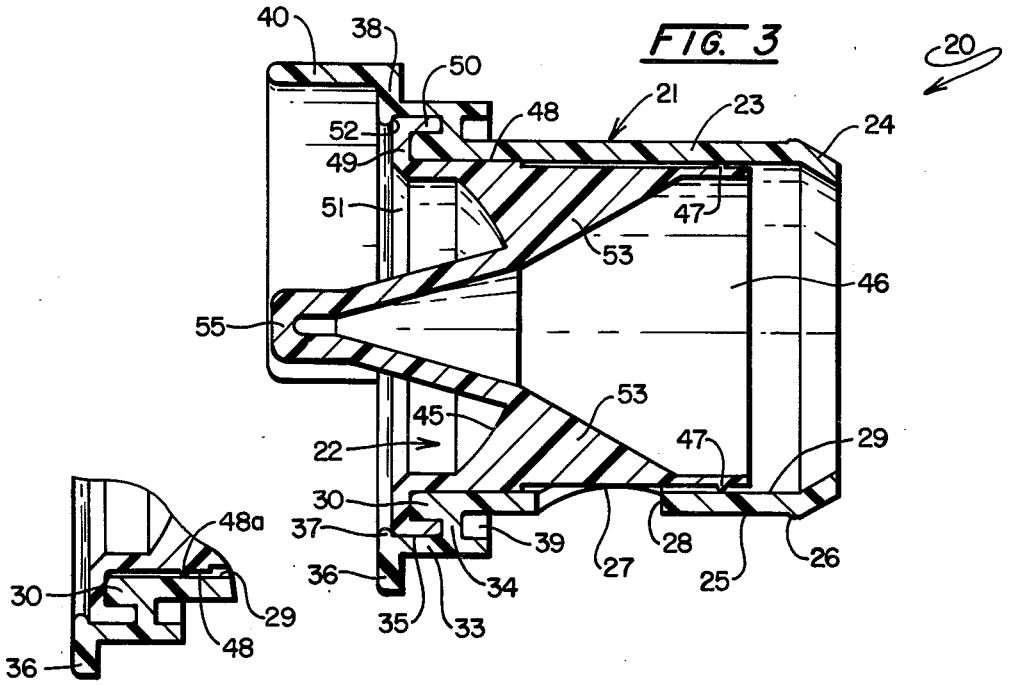
FIG. 3A
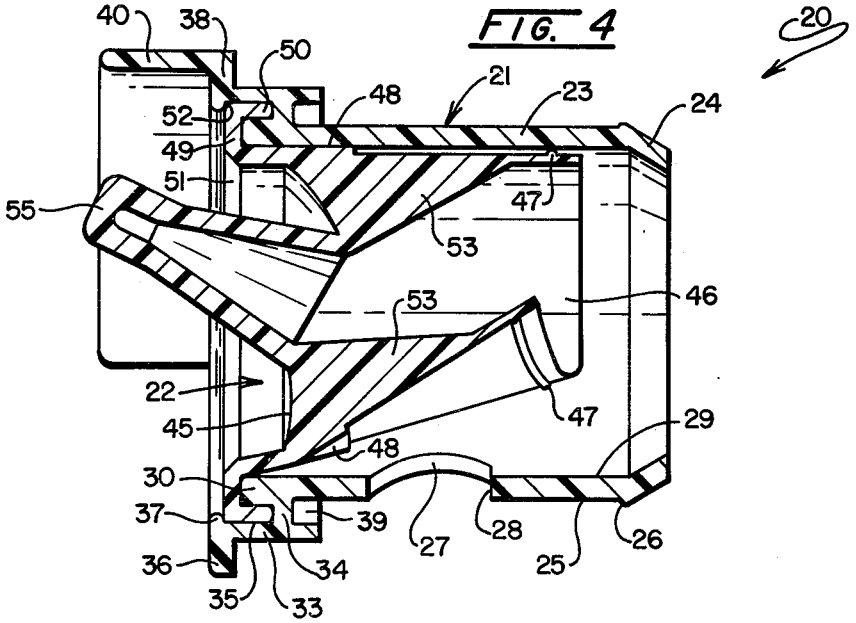

FLEXIBLE DISPENSER VALVE

BACKGROUND OF THE INVENTION

Self-closing valves of the general type including an elastomeric concave diaphragm, which are opened by a toggle-actuating projection from the diaphragm, are disclosed in patents to Fattori U.S. Pat. No. 3,400,866 and Welsh U.S. Pat. No. 3,972,452 and it is specified in these patents that these valves are generally applied to liquid containers formed of film material and housed in a cardboard box and, one example of this type of container is disclosed in U.S. Pat. No. 3,173,579. Difficulty has been encountered with the sealing arrangements of this general type of valve during shipping and long periods of non-dispensing, due not only to seepage but to accidental opening by shock or engagement of the toggle-actuating projection. Furthermore, the diaphragm-actuated sealing arrangements of the prior art are delicate and have a tendency to become damaged, especially during filling of the container, and this damage may cause subsequent improper sealing with resulting leakage. Also, even if the seals are perfect there is a tendency for them to leak to permit seepage after long non-dispensing periods. Furthermore, the prior art valves are usually close to the box, when dispensing, and it is, therefore, difficult to open the valve. Also, the dispersed fluid tends to flow back towards or under the box.

SUMMARY OF THE INVENTION

The valve of the present invention is made of two separate units, an outer protective mounting and sealing unit and an inner sealing unit having toggle-actuated valve. The outer unit consists of a protective tubular member, which has an outlet orifice formed axially of its length, and which is adapted to be mounted axially within the tubular spout of the container in sealing contact therewith for axial slidable movement between a retracted non-dispensing position, covered and sealed by the spout, to an extended dispensing position, where its orifice is out of the spout and exposed. The inner valve unit consists of a resiliently flexible transversely extending but concave diaphragm which carries an axially-inwardly extending resiliently flexible sealing skirt, which is adapted to telescope within and engage the tubular protective and mounting sleeve to ordinarily cover the outlet orifice formed therein. By means of a toggle arrangement cooperating with the diaphragm, including a toggle lever extending outwardly therefrom, the diaphragm may be flexed to distort the sealing skirt and form a dispensing passage between it and the outer sleeve leading to the orifice. Release of the toggle lever, will permit the diaphragm automatically to return to its original non-distorted position and to return the flexible sealing skirt into sealing position over the outlet orifice.

Thus, in effect there is a combination of two cooperating valves, namely, an outer slidable manually operable valve and an inner toggle-actuated valve which is opened manually but is closed automatically.

This dispenser valve assembly is mounted on the spout of a bag which can be positioned in a box. For filling the bag, the valve assembly can be removed from the spout and after filling the bag it can be replaced thereon as an assembly without exposing the more delicate sealing skirt to injury. When the toggle-actuated valve is not needed for dispensing, it will be retracted within the protective sealing sleeve and when it is to be used for dispensing, it will be extended to a readily available position.

BRIEF DESCRIPTION OF THE DRAWINGS

The best mode contemplated for carrying out this invention is illustrated in the accompanying drawings in which:

FIG. 3 is an axial sectional view of the valve taken along line 3—3 of FIG. 2, showing the sealing skirt in closed sealing position;

FIG. 3*a* is a fragmentary section of a modification;

FIG. 4 is a similar view but showing the sealing skirt moved by the toggle lever to an unsealing or open dispensing position;

DETAILED DESCRIPTION OF THE INVENTION

Figure 1:
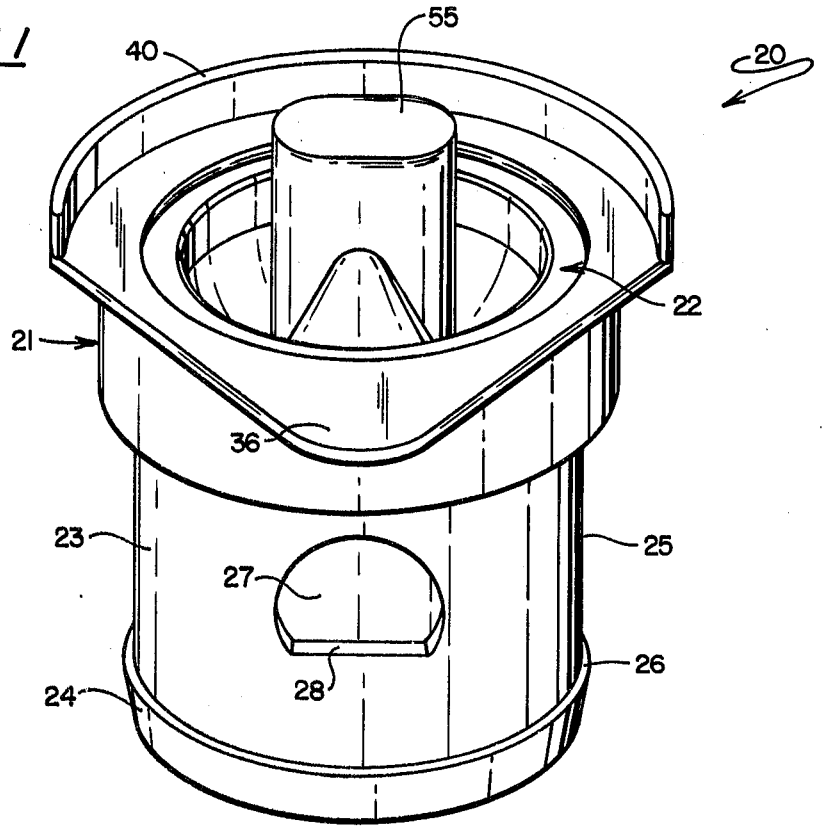
FIG. 1 is a perspective view of the dispenser valve assembly embodying this invention.
Figure 2:
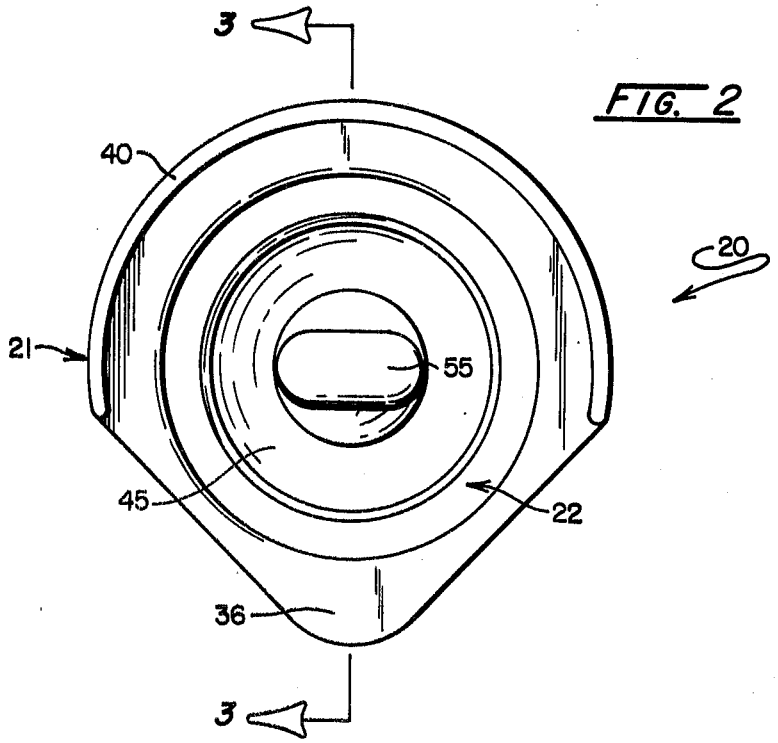
FIG. 2 is an elevational view of the outer end of the valve assembly.
Figure 5:
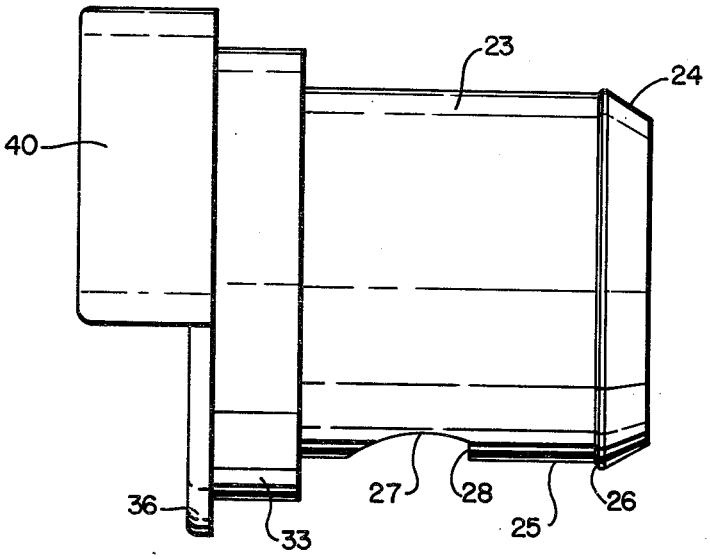
FIG. 5 is a side elevational view of the outer valve unit.
Figure 6:
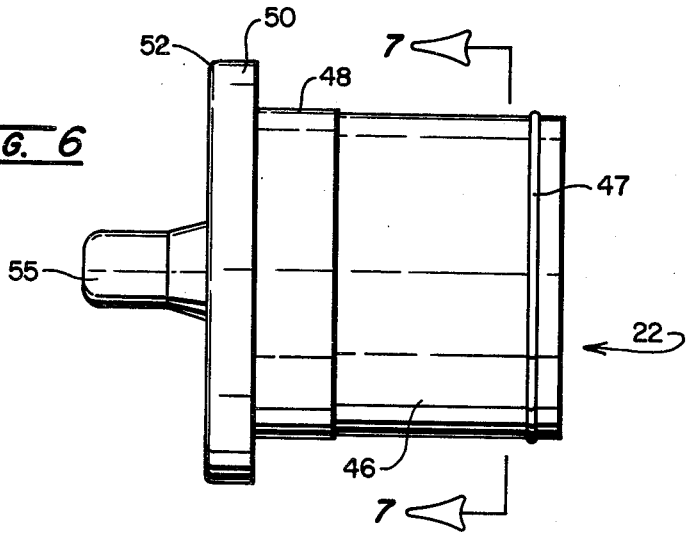
FIG. 6 is a side elevational view of the inner valve unit.
Figure 7:
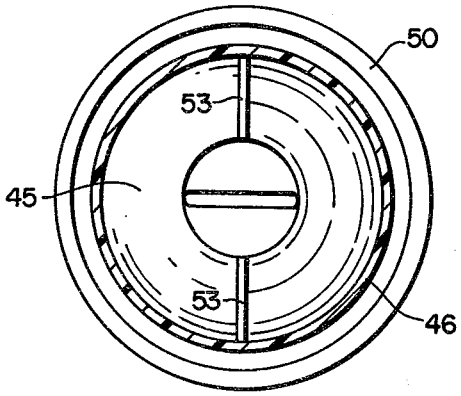
FIG. 7 is a transverse sectional view taken along line 7—7 of FIG. 6.

With specific reference to the drawings, the complete valve assembly 20 is illustrated in FIGS. 1 to 4 and the two main parts or units thereof are illustrated separately in FIGS. 5 to 7. The use of the valve is illustrated in FIGS. 10 to 14.

The valve assembly 20 consists of the outer unit 21 and the inner unit 22. These units are preferably made of suitable plastic and each is mainly of annular cross-section. The unit 21 is an outer valve member for cooperating with a bag spout, as will later appear, but also serves as a protective enclosure or housing for the inner unit 22 which has a normally-closed valve member that can be opened by a toggle action.

The unit 21 is formed preferably of relatively rigid plastic as an open-ended annular tubular member. It can be manufactured as the separate member shown in FIG. 5. It has the tubular or sleeve-like body 23 with an inner end extremity 24 that provides a guide surface which tapers toward its axis. Just axially outwardly of this tapered extremity 24, on the peripheral surface 25 of the body 23, is a stop or retaining rib or shoulder 26 which is shown continuous around the body but need not be. About midway of the length of the tubular body 23 is a radial dispensing orifice 27. This orifice is mainly of circular outline but has a flat inner side or lip 28 over which discharge will occur, when the valve assembly is diepsnsing. The tubular body 23 is thickened at its outer end 30. Radially outwardly of the extremity 30 is a peripheral flange 33 which is concentric with the body 23 and integral therewith, being connected thereto by an annular rib 34. This produces an outwardly opening annular flange-receiving groove 35, at the outer extremity 30 of the body 23, and an inwardly-opening groove 39. It will be noted that the flange 33 extends axially-outwardly beyond the outer extremity. The flange 33 has a radially-outwardly extending lip 36 in the form of an arrow or a pointer, the center line of which aligns in an axial plane with the center of the orifice 27, to indicate the angular location of the orifice in the tubular body 23. The flange 33 is provided at its outer edge with an inwardly-directed locking shoulder 37. Extending more than half-way around the peripheral flange 33 is a flange 40, to be engaged by the fingers in actuating the valve, which is concentric with the flange 33 but radially outwardly thereof, being integrally connected thereto at 38.

The unit 22 is formed preferably of relatively resiliently yieldable plastic to provide mainly an outer concave diaphragm 45 and an axially-inwardly extending sealing skirt 46 formed integrally therewith. The concave diaphragm extends inwardly substantially and the skirt 46 is of annular form and concentric therewith and with the skirt being thinner and more flexible than the diaphragm. The skirt is of considerable axial extent and has an outer diameter slightly less than that of the tubular body 23 of the unit 21. For sealing purposes, the flexible sealing skirt 46 is provided with a continuous annular sealing O-ring of rib 47, spaced axially slightly from its inner extremity, and a flat continuous sealing ring or shoulder 48 adjacent its outer end. At this outer end, the unit 22 has a relatively heavy radially-outwardly-projecting flange 49 which has an axially-inwardly extending annular lip 50 at is peripheral edge. The outer flat surface of flange 49 has the inner continuous shoulder 51, which tapers toward the concave diaphragm 45, and the outer sharp shoulder 52 where it joins the outer peripheral surface of the flange. It will be noted that the annular lip 50 is concentric with the sealing skirt 46. It will be noted further that the diaphragm 45 is transversely disposed but extends inwardly substantially and is joined to the interior of the skirt 46 by integral lugs or gussets 53, preferably of triangular form, which are diametrically opposed and connect the diaphragm 45 to the skirt to produce a toggle action under the influence of a valve-opening lever 55. These lugs are in an axial plane which is at a right angle to the plane of the wide lever 55 but one only could be used. This lever 55 is disposed at the center of the concave diaphragm and projects axially outwardly therefrom. It is preferably formed integrally with the diaphragm 45 and is of substantial width.

The units 21 and 22 are assembled by telescoping the unit 22 into the unit 21 as indicated in FIGS. 1 to 4. The unit 22 is moved axially inwardly into the unit 21 until the lip 50 enters into the groove 35 and the shoulder 52 snaps beneath the locking shoulder 37 although shoulder 52 could be cold-formed inplace. This will lock the two units axially together. At this time, the toggle lever 55 will be aligned with the point of lip 36 (FIG. 2) and will be located midway between it and the outwardly-projecting flange 40. It will be noted that the lever 55 projects substantially but not beyond the outer extremity of the flange 40 (FIG. 3). The flexible sealing skirt 46 will extend axially-inwardly within the tubular body 23 so as to cover the orifice 27 thereof. A tight seal will be produced where annular sealing shoulder 47 engages annular sealing surface 29, inwardly beyond the orifice 27 and where flat annular sealing shoulder 48 engages surface 29, outwardly beyond the orifice 27 adjacent the outer extremity of tubular body 23 but a sealing lip **48*a* (FIG. 3*a*) could be added, if desired. Thus, normally the orifice 27 will be sealed by the non-distorted flexible skirt 46 which is kept in that position by the inwardly flexed diaphragm 45 as shown in FIG. 3. When inserted into the unit 21, the unit 22 is oriented so that one of the lugs 53 is at the orifice 27 and centered relative thereto which will be indicated by relative positions of pointer 36 and lever 55**.

However, if it is desired to uncover the orifice 27, the diaphragm 45 may be flexed outwardly by the toggle lever 55. To do this, it can be engaged by the thumb of the hand with other fingers engaging the flange 40 to cause outward distortion of the concave diaphrgm 45 as shown in FIG. 4. Lever 55 will be rocked toward the flange 40 and through the diaphragm 45 and the lugs 53 of this will produce a toggle action which will flex the side of the sealing skirt 46 at the orifice 27 away from that orifice to expose it. As soon as the lever 55 is released, the lever will snap back to its normal position to permit the distorted diaphragm 45 to return to its normal position, as shown in FIG. 3, and thereby return the skirt 46 to its normal sealing position relative to the orifice 27. The shoulder 37 on the tubular member 23 will prevent outward axial movement of the valve member 21 during actuation of the lever 55.

Figure 8:
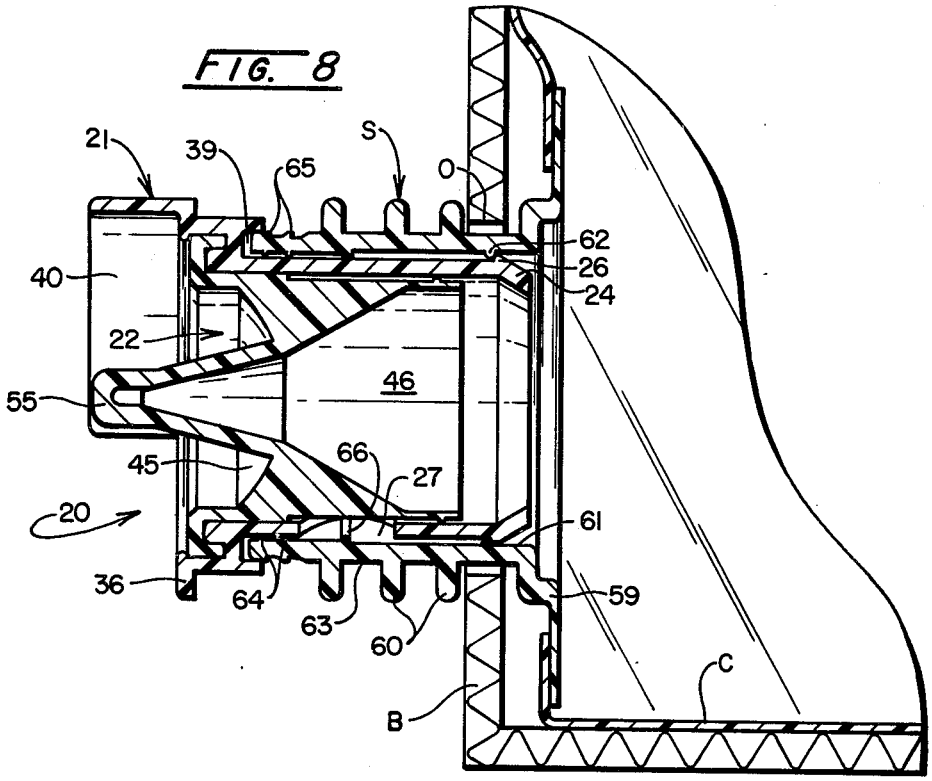
FIG. 8 is an axial fragmentary sectional view of the box-enclosed bag with the valve assembly on the extended spout but in non-dispensing condition.
Figure 9:
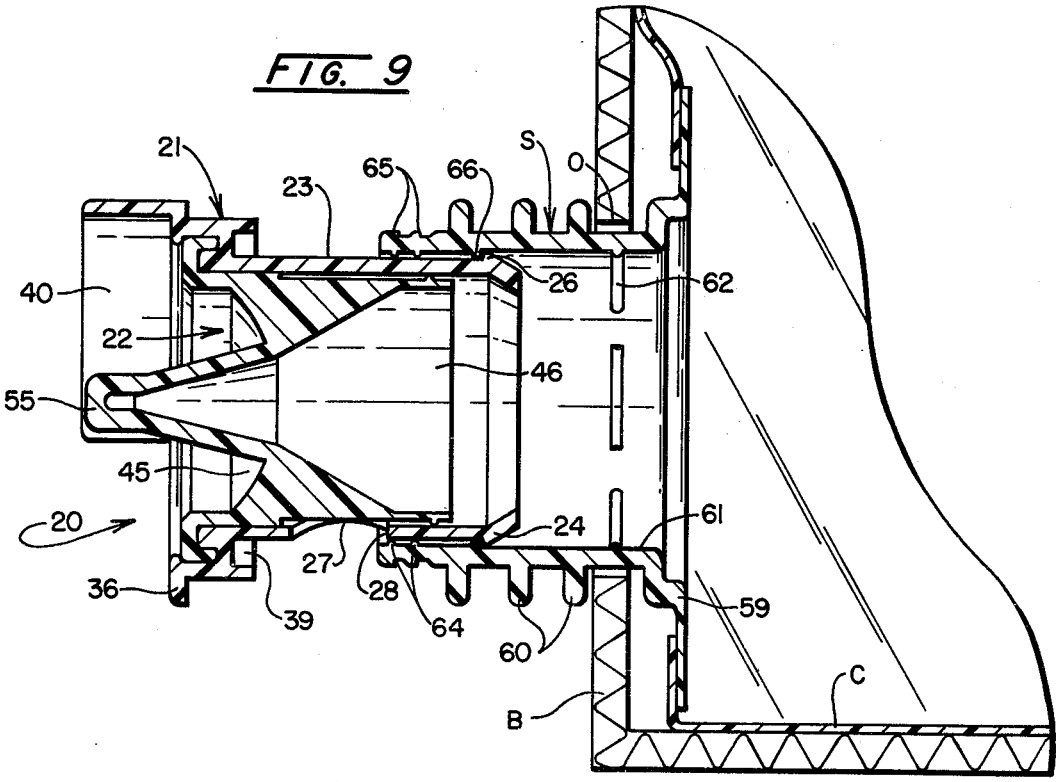
FIG. 9 is a similar view but showing the toggle-actuated valve unit in extended dispensing position.

This valve assembly 20, according to this invention, is adapted to be mounted on a tubular spout as shown in FIGS. 8 and 9. This spout may be the spout S which is attached to a container that may be a bag or pouch C of flexible plastic film material. The bag C may be disposed in a corrugated box or carton B and the spout is used ordinarily for both filling the bag and dispensing from it. When the bag C is to be emptied, the spout S is pulled through an opening O in the box wall and is locked therein between the flanges 59 and 60 of the spout by a well known structure and procedure. The spout is preferably of semi-rigid plastic, is of tubular form and has a plurality of the flanges 60 on the exterior tubular surface 63 thereof axially spaced thereon. On its interior tubular sealing surface 61, the spout has adjacent its inner end, a plurality of angularly spaced retaining shoulders 62, as shown best in FIG. 9, and adjacent its outer end a plurality of continuous sealing rings or shoulders 64 which are axially-spaced thereon. Also, intermediate its ends the surface 61 has a continuous stop and sealing shoulder 66. On its outer tubular surface 63, adjacent its outer end, the spout may have a plurality of axially-spaced continuous shoulders 65 which do not function with the valve assembly.

The valve assembly 20 is slidably mounted on the tubular spout S by telescoping the tubular body 23 of the unit 21 into the axially outwardly-opening spout S, in the manner indicated in FIG. 9, the tapered inner end 24 guiding the body 23 into the tubular spout. The body 23 will fit tightly within the spout S and a seal will be provided by the rings 64. The body 23 will be moved axially inwardly as far as possible, as shown in FIG. 8, until the retaining shoulder 26 snaps behind the retaining shoulders 62 on the surface 61 of the spout. At the same time, the outer end extremity of the spout will move into the groove 39 of the unit 21 so that the spout will be prevented from distorting relative to body 23 to interfere with the seal therebetween at 64.

With the valve assembly 20 in the position shown in FIG. 8, the orifice 27 will be covered by the sleeve-like tubular spout S. The orifice 27, at this time, will be in a position axially inwardly of the sealing rings 64 and no escape of liquid from the spout S can occur, even if some liquid did for some reason, flow out from the bag, through the valve assembly 20 and through the orifice 27 thereof. The orifice 27 is so located axially in the tubular body 23, and is of such axial extent, that there is always either a seal at the rings 64, beyond the orifice, or at the ring 66, inwardly of the orifice, between the slidable tubular body 23 and the spout. The flattening of the orifice at the edge 28 shortens the orifice, in the direction of sliding movement of the unit 21 in the spout and makes this distance less than the distance between seal 66 and outermost seal 64 when orifice 27 is in the position of FIG. 8. It also provides a straight no-drip edge over which the liquid will discharge. At this time orifice 27 is exposed to the bag interior.

The valve assembly 20 will be retained in this retracted non-dispensing position, within the spout S, under normal conditions by cooperation of the retaining shoulders 26 and 62 as shown in FIG. 8. At that time, even if the toggle lever 55 is engaged to cause flexing of the sealing skirt 46 away from sealing position with the orifice 27, the orifice will still be sealed by the covering tubular surface 61 of the spout at the sealing rings 64 thereof. Also, if any liquid seeps through the orifice 27, because of shock or other factors, it will not pass out through the spout beyond the sealing rings 64. However, when it is desired to dispense with the valve assembly 20, the valve unit 21 is extended by sliding its tubular member 23 axially outwardly from the spout, overcoming engagement of shoulders 26 and 62, until the orifice 27 is exposed beyond the spout, as indicated in FIG. 9. The outermost position of member 23, will be limited by its stop or retaining shoulder 26 striking the stop 66 on the spout and, at this time, orifice flat edge 28 will be just within the spout. The pointer 36 will indicate the direction of the orifice 27, and assuming it is directed downwardly as in FIG. 9, the toggle lever 55 can now be actuated to flex the diaphragm 45 which will, in turn, flex the sealing skirt 46 away from the orifice, providing an outwardly directed passage for liquid, between the skirt 46 and surrounding tubular member 23 to the orifice, for receiving the liquid from the spout and directing it outwardly and downwardly through the orifice. As soon as lever 55 is released, the skirt 46 automatically returns to its original position to seal the orifice 27, the main seal being at the shoulder 47.

Figure 10:
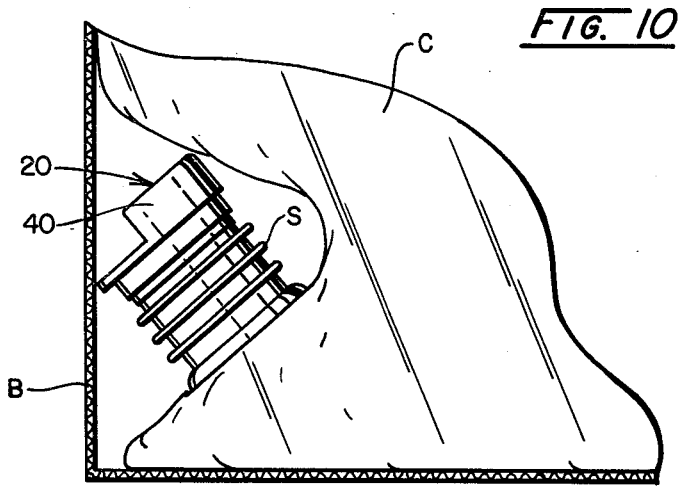
FIG. 10 is a schematic view showing the bag-mounted valve-assembly in the box in shipping or storage position.
Figure 11:
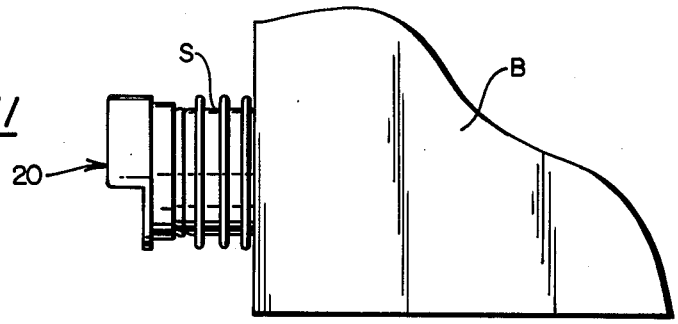
FIG. 11 is a similar view showing the spout with the valve assembly thereon pulled out of the box but with the toggle actuated valve unit in retracted non-dispensing position.
Figure 12:
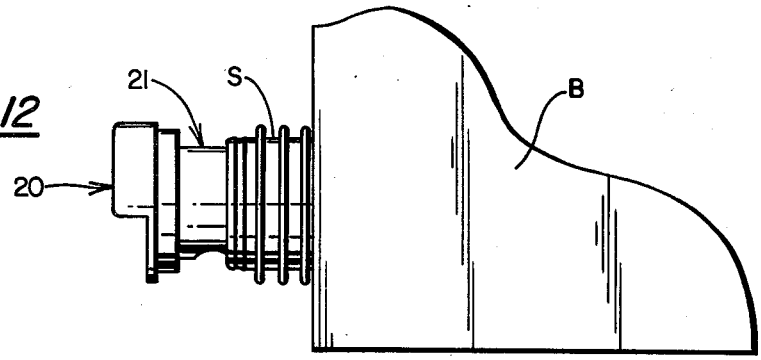
FIG. 12 is a similar view but showing the toggle-actuated valve unit extended to dispensing position.
Figure 13:
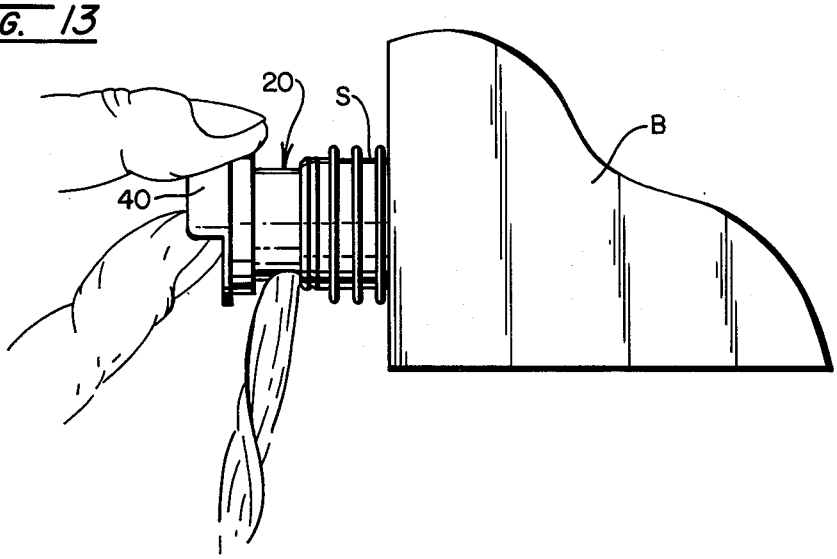
FIG. 13 is a schematic view indicating the dispensing action.

When the filled bag or container C with its spout S is in the box B as shown in FIG. 10, the valve assembly 20, mounted on the spout S, will be retracted mainly within the spout so that it will be protected against seepage or accidental opening due to shock or engagement of the toggle lever 55. This lever will be protected by the flange 40 but even if it is contacted accidentally and the skirt 46 is unseated, liquid cannot escape from the spout because the axially slidable valve unit 21 is in its retracted protected non-dispensing position. To get the package ready for dispensing from the shipping position shown in FIG. 10, the spout S is moved to its extended position relative to the box, as shown in FIG. 11, but with the valve unit 20 still in retracted position on the spout S. If it is desired to keep the container for relatively long periods without dispensing, the valve assembly and spout can be retained in this condition. There will be no seepage during these long periods of inactivity since the valve assembly 20 is acting as a plug in the spout S. To dispense, the valve unit 21 of the valve assembly 20 will be extended axially from the spout to the position shown in FIG. 12 where the orifice 27 will be exposed. Now if the toggle lever 55 is actuated by engaging it with the thumb and the flange 40 with the fingers of one hand as shown in FIG. 13, the toggle valve unit 22 will be opened to dispense the liquid in a stream outwardly and downwardly away from the spout S and box B. As soon as the lever 55 is released, the valve unit 22 of the valve assemble 20 will will automatically close.

Figure 14:
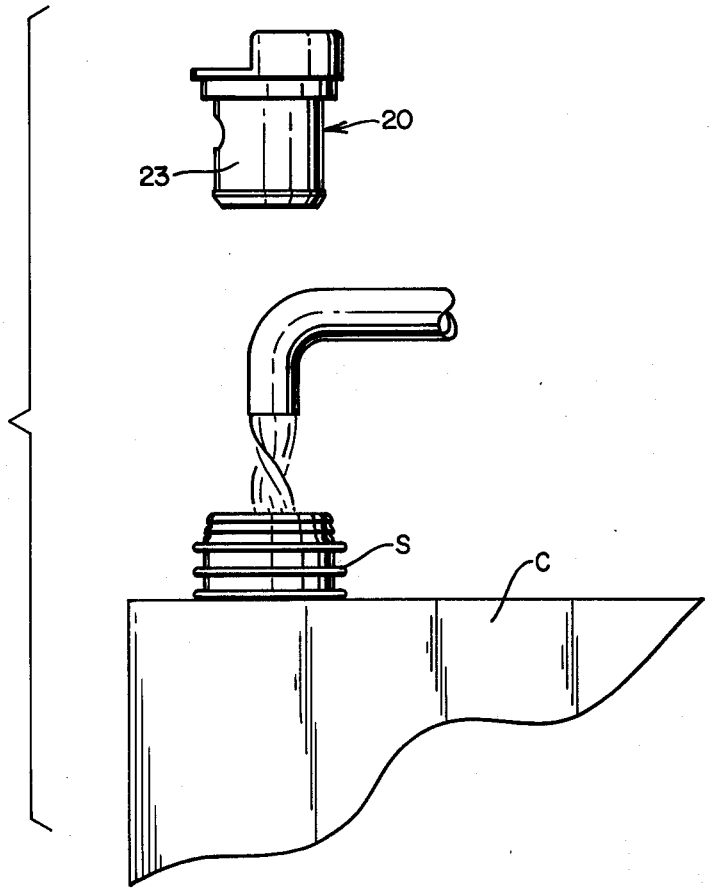
FIG. 14 is a schematic view showing the valve assembly completely removed from the spout to fill the bag.

When filling the container C through the spout S, as shown in FIG. 14, the entire valve assembly 20 can be removed as a unit. At this time, the relatively fragile skirt 46 will be protected by the surrounding tubular member 23. It is not necessary to expose the skirt 46 after the valve is once assembled. After filling of the container, the valve assembly 20 is replaced as a unit on the spout.

It will be apparent that the valve assembly of this invention is, in effect, a combination of two valves, namely, a slidable manually operated valve and a toggle-actuated valve which is self-closing. The valve is made of two parts which facilitates manufacture, but when it is once assembled, the two parts are not separated for filling of the container. When the outer slidable manual valve is retracted in the spout, the inner toggle valve cannot be accidentally opened by moving the toggle lever nor can the valve be opened by shock. Orientation of the inner toggle valve relative to the outer slidable valve can be accomplished with ease and is facilitated by the pointer 36 which indicates the location of the orifice 27. During shipping or storage or periods of inactivity, the toggle-actuated valve is protected by the slidable valve being retracted mainly within the spout. When it is desired to dispense, the slidable valve is extended to expose the orifice and the toggle valve may be readily opened to dispense. The nature of the toggle valve and cooperating slidable valve is such that the stream is directed outwardly rather than inwardly or backwardly toward the container. By operating the toggle lever to lift or flex the sealing skirt to different degrees, the flow can be controlled for gently filling a small receptacle, such as a tumbler, at high head level, or rapidly filling a larger receptacle, such as a carafe, at all head levels. When the toggle is released, the sealing skirt returns automatically to its sealing position and there is no void space which retains liquid, all of it flowing back into the spout so there is no danger of spoilage. When the toggle valve is closed, pressure of the contents of the container will act on the flexible sealing skirt to keep it in expanded sealing position over the orifice.

Having thus described this invention what is claimed is:

1. In combination, a valve assembly comprising an outer tubular valve unit having an orifice and adapted to be slidably mounted in a tubular spout or the like for sliding movement to cover or expose said orifice and an inner toggle-actuated self-closing valve unit mounted within said outer tubular valve unit and having a resiliently flexible sealing skirt which normally lies over and seals the orifice; said inner valve unit including toggle means which can be actuated to flex the sealing skirt away from the orifice to expose it for dispensing; and a tubular spout having an outer end, said outer tubular valve being telescoped within and slidably mounted in said spout for movement from a retracted position where the orifice is within the spout to an extended position where the orifice is beyond the outer open end of the spout.

2. A valve assembly according to claim 1 in which the outer tubular valve unit comprises a body of annular tubular form open at both ends and said orifice is disposed intermediate the length thereof and leads radially therethrough; and said sealing skirt of said inner valve unit is of annular form and fits axially within said tubular body, a resiliently flexible diaphragm carrying said skirt and closing the outer end of said body with the skirt projecting axially inwardly therefrom, and said toggle means including an actuating projection carried by said diaphragm.

3. A valve assembly according to claim 2 in which the diaphragm is of concave form and is transversely disposed to extend axially inwardly into said tubular body, said toggle means including a toggle lever carried by said concave diaphragm and projecting outwardly therefrom and a lug connection between the diaphragm at its inner side and the interior of the sealing skirt so that the resulting toggle action will distort the skirt radially inwardly from the orifice upon distortion of the diaphragm by said toggle lever.

4. A valve assembly according to claim 3 in which the lug connection includes diametrically opposed lugs.

5. A valve assembly according to claim 3 in which the skirt has a continuous annular sealing rib on its exterior surface adjacent its free inner end for normally engaging the interior tubular surface of said tubular body of said outer valve member.

6. A valve assembly according to claim 3 in which the inner valve unit includes a tubular outer end which telescopes within the outer end of said tubular body of the outer valve, and interengaging retaining means between said outer ends to maintain them in axially telescoped relationship.

7. The combination of claim 1 in which the spout is of annular cross-section and the tubular valve is of annular cross-section, and a sealing ring is provided within the spout adjacent its outer end for engaging said tubular valve and another intermediate its end for engaging the tubular valve.

8. The combination of claim 7 in which said spout has a retaining shoulder at its inner end which cooperates with a retaining shoulder on the inner end of said tubular valve member to normally retain the valve member in retracted position, said retaining shoulder in the valve member contacting said intermediate sealing ring to limit movement of said valve member into extended position.

9. The combination of claim 8 in which the tubular valve member has a radial orifice intermediate its ends which is located between said sealing rings of the spout when the tubular valve is retracted, said orifice being mainly of circular form but having a flattened inner edge.

10. The combination of claim 9 in which the orifice is of less extent in a direction at a right angle to said edge than the distance between said outer sealing ring and said intermediate sealing ring on said spout.

11. The combination of claim 8 in which said tubular valve member has a flange structure at its outer end providing a groove for receiving the outer end of said spout when said member is retracted within the spout.

12. The combination of claim 1 in which the valve assembly comprises an outer tubular member of annular form open at both ends and has a radial orifice intermediate its length, said toggle-actuated valve includes a flexible sealing skirt carried by a transverse flexible wall at one end and extending axially into the tubular member in covering relationship to the orifice, and toggle means connected to said transverse flexible wall for distorting it to flex said skirt to expose said orifice.

13. A valve assembly according to claim 12 in which said skirt has a continuous sealing shoulder on its exterior adjacent its inner end for contact with the interior of said tubular member.

14. A valve assembly comprising an outer tubular valve unit having an orifice and adapted to be slidably mounted in a tubular spout or the like for sliding movement to cover or expose said orifice; and an inner toggle-actuated self-closing valve unit mounted within said outer tubular valve unit and having a resiliently flexible sealing skirt which normally lies over and seals the orifice; said inner valve unit including toggle means which can be actuated to flex the sealing skirt away from the orifice to expose it for dispensing; said outer tubular valve unit comprising a body of annular tubular form open at both ends and said orifice being disposed intermediate the length thereof and leading radially therethrough; said sealing skirt of said inner valve unit being of annular form and fitting axially within said tubular body, a resiliently flexible diaphragm carrying said skirt and closing the outer end of said body with the skirt projecting axially inwardly therefrom; said toggle means including an actuating projection carried by said diaphragm, said diaphragm being of concave form and transversely disposed to extend axially inwardly into said tubular body, said toggle means including a toggle lever carried by said concave diaphragm and projecting outwardly therefrom and a lug connection between the diaphragm at its inner side and the interior of the sealing skirt so that the resulting toggle action will distort the skirt radially inwardly from the orifice upon distortion of the diaphragm by said toggle lever, said skirt having a continuous annular sealing rib on its exterior surface adjacent its free inner end for normally engaging the interior tubular surface of said tubular body of said outer valve member, said orifice being mainly of circular form but having a flattened inner edge.

15. A valve assembly comprising an outer tubular value unit having an orifice and adapted to be slidably mounted in a tubular spout or the like for sliding movement to cover or expose said orifice; and an inner toggle-actuated self-closing valve unit mounted within said outer tubular valve unit and having a resiliently flexible sealing skirt which normally lies over and seals the orifice; said inner valve unit including toggle means which can be actuated to flex the sealing skirt away from the orifice to expose it for dispensing; said outer tubular valve unit comprising a body of annular tubular form open at both ends and said orifice being disposed intermediate the length thereof and leading radially therethrough; said sealing skirt of said inner valve unit being of annular form and fitting axially within said tubular body, a resiliently flexible diaphragm carrying said skirt and closing the outer end of said body with the skirt projecting axially inwardly therefrom; said toggle means including an actuating projection carried by said diaphragm, said diaphragm being of concave form and transversely disposed to extend axially inwardly into said tubular body, said toggle means including a toggle lever carried by said concave diaphragm and projecting outwardly therefrom and a lug connection between the diaphragm at its inner side and the interior of the sealing skirt so that the resulting toggle action will distort the skirt radially inwardly from the orifice upon distortion of the diaphragm by said toggle lever said skirt having a continuous annular sealing rib on its exterior surface adjacent its free inner end for normally engaging the interior tubular surface of said tubular body of said outer valve member, said inner valve unit including a tubular outer end which telescopes within the outer end of said tubular outer end which telescopes within the outer end of said tubular body of the outer valve and interengaging retaining means between said outer ends to maintain them in axially telescoped relationship, said upper end of the inner valve having an inner flange structure which interfits with an outer flange structure on the upper end of said tubular body, and said interengaging retaining means comprising a retaining rib extending radially inwardly from the outer flange structure over the inner flange structure.

16. A valve assembly according to claim 15 in which a radially-extending pointer is formed on the outer flange structure to indicate the radial position of said orifice.

17. A valve assembly according to claim 16 in which the toggle lever is relatively wide, said outer flange structure having a projecting flange portion radially of the lever to be engaged by the fingers when the lever is engaged by the thumb.

18. A valve assembly according to claim 17 in which said lug connection comprises at least one lug connected between the diaphragm and the sealing skirt located in an axial plane at right angles to that of the lever and which is common with the plane of the center of said orifice.

* * * * *